United States Patent [19]

Hooghordel et al.

[11] Patent Number: 4,577,136

[45] Date of Patent: Mar. 18, 1986

[54] CATHODE-RAY TUBE HAVING A GETTERING DEVICE AND GETTERING DEVICE SUITABLE FOR SAID TUBE

[75] Inventors: Rijk Hooghordel; Franciscus P. van Jole, both of Eindhoven, Netherlands

[73] Assignee: U.S. Philips Corporation, New York, N.Y.

[21] Appl. No.: 546,265

[22] Filed: Oct. 28, 1983

[30] Foreign Application Priority Data

Nov. 11, 1982 [NL] Netherlands ..... 8204366

[51] Int. Cl.[4] ..... H01J 29/94

[52] U.S. Cl. ..... 313/481; 313/558; 313/559; 313/561; 417/48; 445/55

[58] Field of Search ..... 445/55; 417/48; 313/558, 559, 553, 561, 481

[56] References Cited

U.S. PATENT DOCUMENTS 3,768,884 10/1973 Porta et al. ..... 445/55

4,225,805 7/1980 Smithgall et al. ..... 313/481

4,535,267 8/1985 Martelli et al. ..... 445/55

*Primary Examiner*—Arthur Kellogg

*Attorney, Agent, or Firm*—Robert J. Kraus

[57] ABSTRACT

In a cathode-ray tube having a glass envelope portion, a gettering device (18) is urged against an internal wall portion of the glass envelope portion (2) by means of a resilient metal strip (19) connected to a component of the tube. The gettering device comprises a getter holder (30) in the form of an annular metal channel which is connected to the resilient metal strip (19) via a metal connection strip (32) and furthermore is kept, spaced from the wall portion by a metal support member (33). The support member is formed by a metal supporting arm (33) extending from the metal connection strip (32) which at its free end (34) is curved convexly with respect to the wall portion and contacts the wall portion in an area (35) situated centrally with respect to the annular channel (30). This arrangement enables the temperature of the support member at the area where it contacts the wall portion to be kept below 700° C. during the inductive heating of the gettering device, thereby preventing glass damage as a result of a thermal overload of the wall portion.

6 Claims, 11 Drawing Figures

CATHODE-RAY TUBE HAVING A GETTERING DEVICE AND GETTERING DEVICE SUITABLE FOR SAID TUBE

BACKGROUND OF THE INVENTION

The invention relates to a cathode-ray tube having a glass envelope portion and a gettering device which comprises a getter holder in the form of an annular metal channel, which gettering device is urged against an internal wall portion of the glass envelope portion by means of a resilient metal strip connected to a component of the tube. The metal channel is connected via a metal connection strip to the resilient metal strip and is kept spaced from the wall portion by means of a metal support member.

The invention furthermore relates to a gettering device suitable for such a tube.

Such a cathode-ray tube is known from German Auslegeschrift No. 1950230, corresponding to British Pat. No. 1,274,289. In the tube the metal support member consists of a piece of wire, the two ends of which are bent at right angles and are curved convexly with respect to the tube wall. The spacing between the convexly curved end sections is approximately equal to the diameter of the annular getter holder. The convexly curved end sections determine the supporting points for the gettering device on the tube wall. Therefore, in this known construction the supporting points are directly below and at a very short distance from the annular getter holder.

In cathode-ray tubes it is usual to use gettering devices of the type which are inductively heated to cause the gettering metal to be evaporated. During the evaporation process the temperature of the getter holder and its filling may increase to approximately 1300° C. The temperature of the support members may reach undesirably high values as a result of thermal radiation and thermal conductivity. This may result in glass damage at the area where the support member contacts the glass wall of the tube. Experiments have demonstrated that such glass damage does not occur when the temperature of the support member at the area where it contacts the glass wall does not exceed approximately 700° C. It becomes more difficult to satisfy this requirement as the diameter of the annular holder of the gettering devices become smaller.

SUMMARY OF THE INVENTION

It is an object of the invention to provide a cathode-ray tube having a gettering device in which the metal support member of the gettering device, particularly for a comparatively small diameter of the annular holder, is suitable to avoid thermal overload of the tube wall during the evaporation of the gettering metal. A cathode-ray tube employing the invention has a glass envelope portion and a gettering device comprising a getter holder in the form of an annular metal channel, the gettering device being urged against an internal wall portion of the glass envelope portion by means of a resilient metal strip connected to a component of the tube. The metal channel is connected to the resilient metal strip via a metal connection strip and is kept spaced from the wall portion by a metal support member. The support member is formed by a metal support arm which extends from the metal connection strip. At its free end the support member is convexly curved relative to the wall portion and contacts the wall portion in an area situated centrally with respect to the annular channel.

Experiments have demonstrated that the heating of the support member at the area where it contacts the tube wall is caused primarily by thermal radiation emanating from the getter holder. The heating by radiation is reduced by means of the construction in accordance with the invention because the contact place of the support member and the tube wall is situated in an area which is located centrally with respect to the annular getter holder. As compared with the known construction the invention has the advantage that the distance between the contact place and the getter holder is larger so that heating of the support member at that area by radiation is smaller.

According to a further embodiment of the invention the place where the support arm extends from the metal connection strip is situated laterally at some distance from the annular getter holder. In this manner, the path along which thermal conduction takes place from the getter holder via a path of the connection strip and the support arm to the contact place of support arm and tube wall is increased. Heating of the contact place by thermal conductivity is thus restricted.

It is also possible to place the support member and the contact place thereof with the tube wall both laterally at some distance from the getter holder. The thermal aspect of such construction would be favourable, but the disadvantage is that the distance between the getter holder and the tube wall can be controlled less accurately so that the reproducibility of the inductive heating process decreases.

According to still another embodiment of the invention, the metal connection strip fully extends over the support arm and thus forms a heat screen between the support arm and the annular getter holder.

Yet another embodiment of the invention is characterized in that the support arm is formed by a lug cut out of the metal connection strip. A further embodiment hereof is characterized in that the part of the metal connection strip connected to the getter holder comprises a widened end section from which at least three lugs have been cut, the outermost lugs being connected to the getter holder and at least one lug disposed between the outermost lugs forming the support arm.

BRIEF DESCRIPTION OF THE DRAWING

The invention will now be described in greater detail, by way of example, with reference to a number of embodiments and the accompanying drawing, in which.

DESCRIPTION OF THE PREFERRED EMBODIMENTS

Figure 1:
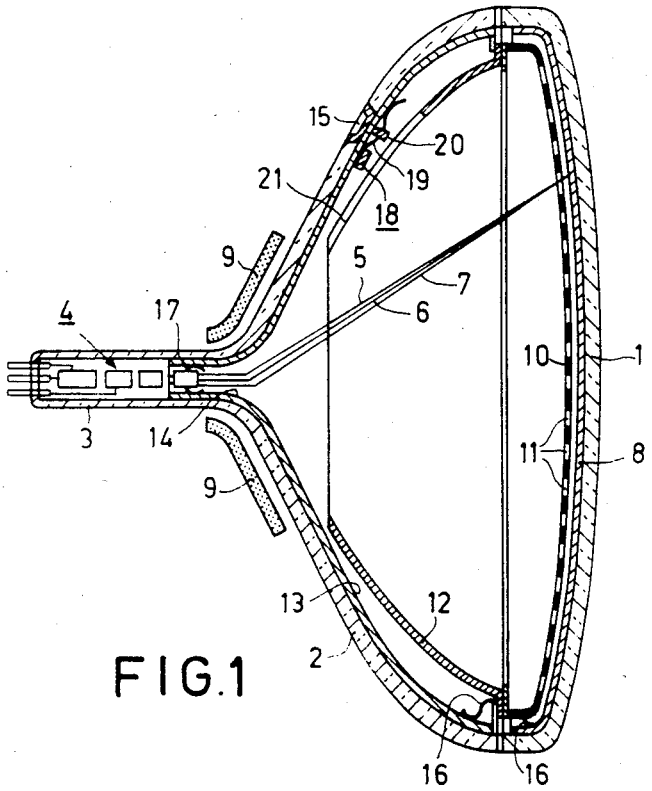
FIG. 1 is a diagrammatic sectional view of a cathode-ray tube according to the invention having a gettering device connected therein.

The cathode-ray tube shown in FIG. 1 is a diagrammatic vertical sectional view of a colour television display tube. The tube comprises a glass envelope consisting of a display window 1, a funnel portion 2 and a neck 3. An electrode system 4 for generating three electron beams 5, 6 and 7 is provided in the neck 3. The electron beams are directed at a display screen 8 provided internally on the display window 1 and consisting of a great number of phosphor regions luminescing in red, green and blue. On their way to the display screen 8 the electron beams 5, 6 and 7 are deflected over the display screen 8 by means of a number of deflection coils 9 and pass through a colour selection electrode 10 having apertures 11. The electron beams 5, 6 and 7 pass through the apertures 11 at a small angle with each other and consequently each impinge only on phosphor regions of one colour. The tube furthermore comprises an internal metal screening cone 12 which screens the electron beams 5, 6 and 7 from the earth's magnetic field. The inner wall of the tube is covered with an electrically conductive layer 13 which is connected to a high voltage contact 15 provided in the tube wall and is further connected, via contact springs 16, to the colour selection electrode 10 and the display screen 8 and, via contact springs 17, to the last electrode of the electrode system 4.

Figure 2A:
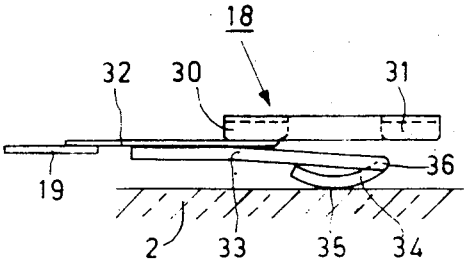
FIGS. 2*a* and 2*b* are a diagrammatic side elevation and a bottom view, respectively, of a gettering device according to the invention.

As is known, a layer of gettering metal, for example, barium, is deposited on the tube wall after evacuating the tube, to getter the residual gases remained in the tube and to maintain a high vacuum in the tube during the life of the tube. For that purpose, a gettering device 18 provided in the tube is urged against the wall of the glass funnel portion 2 by means of a resilient metal strip 19 connected to the high voltage contact 15. The gettering device 18 consists of an annular metal channel 30 in which, as shown in FIG. 2*a*, a powder mixture 31 of barium-aluminium and nickel in the weight ratio of approximately 1:1 is compressed. By means of inductive heating an exothermal reaction is initiated between the barium-aluminium and the nickel, the barium evaporating and being deposited, via an aperture 21 in the screening cone 12, onto internal surfaces of the tube. The temperature of the getter holder 30 and its contents 31 can rise to approximately 1300° C. during the evaporation process. It is hence necessary to keep the getter holder 30 spaced from the glass tube wall. This is done by means of a support member with which the gettering device bears on the tube wall. In order to prevent glass damage by thermal overload of the tube wall, the temperature of the support member at the area where it contacts the tube wall may not exceed approximately 700° C. This requirement is satisfied by means of a construction which is shown diagrammatically in a side elevation and a bottom view, respectively, in FIGS. 2*a* and 2*b*. The annular holder 30, which has an outside diameter of approximately 16 mm, is welded to the resilient metal strip 19 by means of a metal connecting strip 32. A wire-shaped support arm 33 is welded at one end to the connecting strip 32 and at its free end has an end section 34 which, at 36, is bent backwards and convexly with respect to the wall portion 2. In this construction the bent-over end section 34 extends the path of thermal conductivity from the metal holder 30 to the contact place 35 between the end section 34 and the wall portion 2. This path of thermal conductivity is approximately 20 mm in the embodiment shown. Furthermore, the contact place 35 is situated in an area located centrally with respect to the annular holder 30. With a distance of approximately 3 mm between the holder 30 and the wall portion 2, the temperature of the construction of the support arm at the area of the contact place 35 was found to remain well below 700° C. and no damage to the wall portion 2 occurred. In order to enable precision welding, the support arm 33 comprises a bent-over end 44. As an alternative, as shown in FIG. 5*b*, the support arm may for that purpose also have a flattened end 37.

Figure 2B:
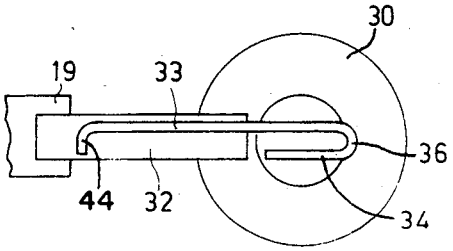
Figure 3A:
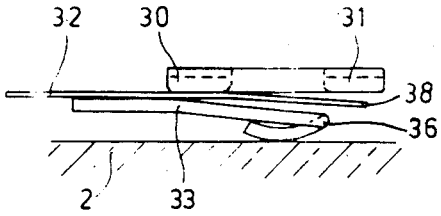
FIGS. 3*a* and 3*b* are a side elevation and a bottom view, respectively, of a further embodiment of the gettering device.
Figure 3B:
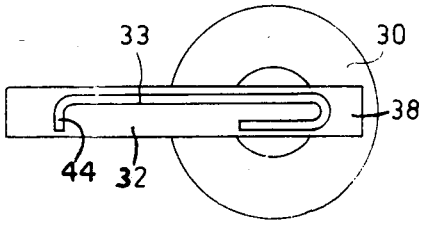
Figure 4A:
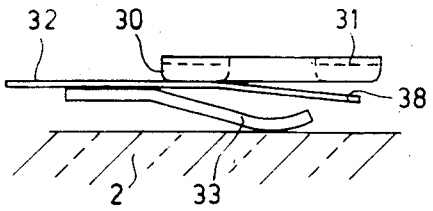
FIGS. 4*a* and 4*b* are a diagrammatic side elevation and a bottom view, respectively, of another embodiment of the invention.
Figure 4B:
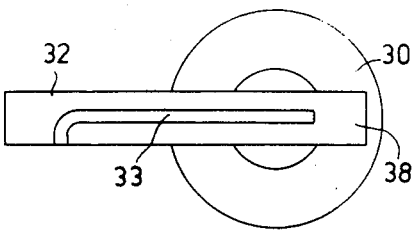

FIGS. 3 to 6 show diagrammatically and in a manner analogous to FIGS. 2*a* and 2*b* various embodiments of the invention. For simplicity, corresponding components of a gettering device are referred to by the same reference numerals. FIGS. 3*a* and 3*b* differ from FIGS. 2*a* and 2*b*, respectively, as regards the gettering device in that the connecting strip 32 extends over the whole support arm 33 by means of an extension 38. The extension 38 slightly screens the support arm 33 from the thermal energy radiated by the metal holder. Such a construction is also shown in FIGS. 4*a* and 4*b*, but the bent over end section 34 shown in FIGS. 2*a* to 3*b*, for extending the path of thermal conductivity, may be omitted.

Figure 5A:
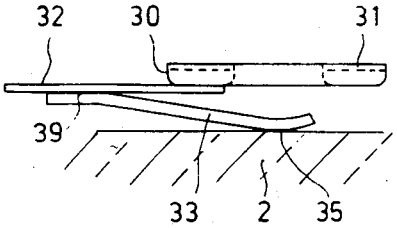
FIGS. 5*a* and 5*b* are a diagrammatic side elevation and a bottom view, respectively, of yet another embodiment of the invention.
Figure 5B:
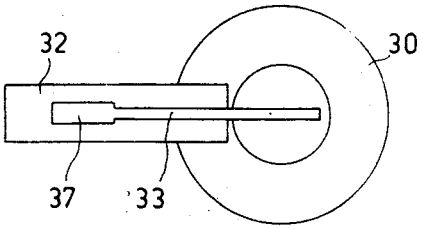

As shown in FIG. 5*a*, instead of or in combination with the bent-over end section 34, the path of thermal conductivity may be extended by locating the place 39 where the supporting arm 33 is welded to the connecting strip 32, laterally at some distance from the holder 30. In this manner, a part of the connecting strip 32 situated outside the holder 30 is included in the path of thermal conductivity from the holder 30 to the contact place 35.

Figure 6A:
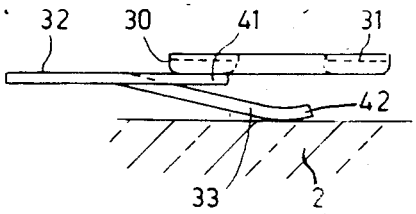
FIGS. 6*a* and 6*b* are a side elevation and a bottom view, respectively, of still another embodiment of the invention.
Figure 6B:
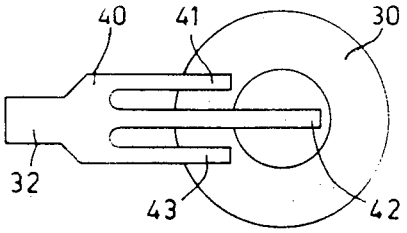

FIGS. 6*a* and 6*b* show a special embodiment of the invention. The connecting strip 32 has a widened end section 40 from which three lugs 41, 42 and 43 are formed. The two outermost lugs 41 and 43 are welded to the annular holder 30, while the central lug 42 forms the support arm 33. The manufacture of the construction is simplified in that the connecting strip 32 and the support arm 33 are integrally formed. In this respect a further simplification can be obtained, if desired, by causing the connecting strip 32 to form one assembly with the resilient strip 19 shown in FIGS. 1, 2*a* and 2*b*.

The invention is not restricted to the embodiments described. The resilient metal strip 19 may be connected to any component of the tube suitable for that purpose, such as the electrode system 4 or the metal screening cone 12.

What is claimed is:

1. In a cathode-ray tube comprising a glass envelope containing electrical components and an annular getter holder having a central opening, support means for supporting the getter holder in the envelope, said support means comprising:

(a) a resilient metal strip having a first portion connected to one of the electrical components;

(b) a metal connecting strip having a first portion connected to the getter holder and having a second portion connected to a second portion of the resilient metal strip; and (c) a metal support arm having a first portion connected to the connecting strip at a predetermined location between said first and second portions of the strip, said support arm extending toward an inner surface of the envelope and including an end portion curved toward said inner surface, said curved end portion contacting said inner surface at a position beneath the central opening of the getter holder and spacing the getter holder at a predefined distance from the envelope;

the length of the metal support arm, from the end portion to the predetermined location of the connecting strip, and the length of the connecting strip, from said predetermined location to the first portion thereof, having predefined measurements, thereby establishing a predefined thermal conduction path length from the getter holder to the envelope;

said position of the support arm end portion, said predefined distance, and said predefined path length collectively limiting radiated and conducted heat transfer from the getter holder to the envelope during heating of the getter holder.

2. A cathode-ray tube as in claim 1 where the metal support arm includes a bent portion for increasing said thermal conduction path length.

3. A cathode-ray tube as in claim 1 or 2 where the metal connecting strip includes a thermal screen portion extending between the getter holder and the support arm.

4. A cathode-ray tube as in claim 1 or 2 where the support arm comprises an integral portion of the connecting strip extending from said predetermined location of said connecting strip.

5. A cathode-ray tube as in claim 4 where the connecting strip comprises a plurality of arms extending from said predetermined location, one of said arms forming said support arm, and at least one of said arms including said first portion of said connecting strip which is connected to the getter holder.

6. A cathode-ray tube as in claim 5 where the connecting strip comprises two of said arms connected to the getter holder.

* * * * *